US010737306B2

(12) United States Patent
Maierl et al.

(10) Patent No.: US 10,737,306 B2
(45) Date of Patent: Aug. 11, 2020

(54) COILING DEVICE WITH ASYMMETRIC COOLING OF THE COILED STRIP

(71) Applicant: Primetals Technologies Austria GmbH, Linz (AT)

(72) Inventors: Josef Maierl, Neuhofen an der Krems (AT); Lukas Pichler, Linz (AT); Alois Seilinger, Linz (AT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 377 days.

(21) Appl. No.: 15/552,869

(22) PCT Filed: Dec. 16, 2015

(86) PCT No.: PCT/EP2015/079996

§ 371 (c)(1),
(2) Date: Aug. 23, 2017

(87) PCT Pub. No.: WO2016/134801

PCT Pub. Date: Sep. 1, 2016

(65) Prior Publication Data

US 2018/0029098 A1 Feb. 1, 2018

(30) Foreign Application Priority Data

Feb. 27, 2015 (EP) ..... 15156829

(51) Int. Cl.
*B21C 47/04* (2006.01)
*B21C 47/26* (2006.01)
(Continued)

(52) U.S. Cl.
CPC ..... *B21C 47/04* (2013.01); *B21C 47/26* (2013.01); *B21C 47/3433* (2013.01); *B21B 45/0218* (2013.01)

(58) Field of Classification Search
CPC ..... B21C 47/04; B21C 47/26; B21C 47/3433; B21B 45/0218; B21B 45/0251; B21B 15/005
(Continued)

(56) References Cited

U.S. PATENT DOCUMENTS 4,482,402 A * 11/1984 Taub ..... C21D 9/56 148/121
8,359,894 B2 1/2013 Yoshii et al. ..... 72/201
(Continued)

FOREIGN PATENT DOCUMENTS

AU 2010333187 B2 * 11/2010
CN 101479055 A 7/2009
(Continued)

OTHER PUBLICATIONS

Office Action dated May 13, 2019 issued in corresponding Russian Patent Application No. 2017133418/02(058955)—no English translation provided.
(Continued)

*Primary Examiner* — Teresa M Ekiert
(74) *Attorney, Agent, or Firm* — Ostrolenk Faber LLP

(57) ABSTRACT

For a rolled metal strip, in particular a steel strip; a drive roller unit deflects the metal strip from a first transportation direction to a second transportation direction, and the strip is then fed to a coiler. The metal strip is coiled in the coiler to form a coil having a coil diameter. Plastic deformation of an end portion of the metal strip is caused such that the end portion in its uninfluenced state is curved at a curvature radius. The plastic deformation of the end portion (8) is at least partially caused by an asymmetric impingement with a cooling medium (21) on the sides of the end portion (8). The impingement of the end portion (8) with the cooling medium (21) is performed across a length of the end portion (8) that
(Continued)

is longer than half the outermost coiling of the coil (6) but smaller than the outermost coiling of the coil (6).

12 Claims, 2 Drawing Sheets

(51) Int. Cl.
*B21C 47/34* (2006.01)
*B21B 45/02* (2006.01)

(58) Field of Classification Search
USPC ..... 72/128
See application file for complete search history.

(56) References Cited

U.S. PATENT DOCUMENTS

| | | | | |
|---|---|---|---|---|
| 9,815,101 | B2 | 11/2017 | Krimpelstätter | |
| 2009/0184191 | A1 | 7/2009 | Müller et al. | 242/535 |
| 2018/0029098 | A1* | 2/2018 | Maierl | B21C 47/04 |

FOREIGN PATENT DOCUMENTS

| | | | |
|---|---|---|---|
| CN | 102962296 | A | 3/2013 |
| CN | 103889605 | A | 6/2014 |
| EP | 0 906 797 | A1 | 4/1999 |
| EP | 2 465 620 | A1 | 6/2012 |
| JP | S52-129657 | A | 10/1977 |
| JP | S52-129657 | A | 10/1977 |
| JP | H05-261432 | A | 10/1993 |
| JP | 2003-211214 | A | 7/2003 |
| JP | 2010-162594 | A | 7/2010 |
| JP | 2010-162595 | A | 7/2010 |
| JP | 2010-162595 | A | 7/2010 |
| JP | 2012-024793 | A | 2/2012 |
| JP | 2013-081990 | A | 5/2013 |
| RU | 2 224 609 | C1 | 2/2004 |
| SU | 1391758 | A1 | 4/1988 |
| WO | WO 2008/000348 | A1 | 1/2008 |
| WO | WO 2011/073016 | A1 | 6/2011 |

OTHER PUBLICATIONS

Office Action dated May 30, 2018 issued in corresponding Chinese Patent Application No. 201580076977.4 with English translation.
Japanese Office Action, dated Nov. 19, 2018, issued in corresponding Japanese Patent Application No. 2017-545311. English Translation. Total pp. 6.
International Search Report dated Mar. 2, 2016 in corresponding PCT International Application No. PCT/EP2015/079996.
Written Opinion dated Mar. 2, 2016 in corresponding PCT International Application No. PCT/EP2015/079996.
European Search Report dated Aug. 18, 2015 in corresponding European Patent Application No. 15156829.2.
Office Action dated Mar. 2, 2020 issued in corresponding Japanese Patent Application No. 2017-545311, filed Dec. 16, 2015—English translation provided.

* cited by examiner

COILING DEVICE WITH ASYMMETRIC COOLING OF THE COILED STRIP

CROSS-REFERENCE TO RELATED APPLICATIONS

The present application is a 35 U.S.C. § 371 national phase conversion of PCT/EP2015/079996, filed Dec. 16, 2015, which claims priority of European Patent Application No. 15156829.2, filed Feb. 27, 2015, the contents of which are incorporated by reference herein. The PCT International Application was published in the German language.

TECHNICAL BACKGROUND

The present invention relates to a method for coiling a rolled metal strip, in particular a steel strip,

- wherein the metal strip is deflected by a drive roller unit from a first transportation direction to a second transportation direction and is fed to a coiler;
- wherein the metal strip in the coiler is coiled to form a coil having a coil diameter;
- wherein a plastic deformation of an end portion of the metal strip is caused such that the end portion in the uninfluenced state is curved at a radius of curvature;
- wherein the plastic deformation of the end portion is at least partially caused by an asymmetric impingement on the sides of the end portion with a cooling medium prior to and/or during the coiling of the end portion.

The present invention furthermore relates to a coiling installation for coiling a rolled metal strip, in particular a steel strip,

- wherein the coiling installation has a drive roller unit which deflects the metal strip from a first transportation direction to a second transportation direction;
- wherein the coiling installation has a coiler to which the metal strip is fed from the drive roller unit in the second transportation direction and in which the metal strip is coiled so as to form a coil having a coil diameter;
- wherein the coiling installation has a deformation installation which causes a plastic deformation of an end portion of the metal strip such that the end portion in the uninfluenced state is curved at a curvature radius;
- wherein the deformation installation is configured as a cooling installation which impinges on the end portion with a cooling medium prior to and/or during the coiling of the end portion.

In hot-rolling lines, after the final rolling pass, a metal strip, usually a steel strip, is typically initially cooled to a predefined temperature (coiling temperature) in a cooling section. Thereafter, the cooled strip is coiled to form a coil. It is possible for the coiling temperature to be constant, when viewed along the length of the metal strip. Alternatively, when viewed along the length of the metal strip, it is possible for the coiling temperature to be variable. For example, the strip head (i.e. the front end of the strip) and the strip tail (i.e. the rear end of the strip) can be coiled when not cooled. The coiled coil is subsequently secured for storage and for transportation against any self-acting unwinding or opening. For this purpose, the coil is typically removed from the coiler by a transportation device and fed to a strapping machine. Securing is performed in the strapping machine. Prior to being pulled from the coiling mandrel, the coiled coil is rotated such that the end of the strip projects only slightly beyond the lowermost point of the coil, and the coil is thus stabilized by its own weight.

A plastic deformation of the metal strip typically arises already during the coiling of the metal strip so as to form the coil. Nevertheless, spontaneous opening or unrolling, respectively, of an as yet unsecured coil can arise in many cases. The reason this lies in elastic residual stresses in the coilings of the coiled coil. The degree of these residual stresses depends on several factors, for example on the thickness of the strip and on the flow stress at the coiling temperature. Spontaneous opening or unrolling, respectively, of this type can arise particularly in the case of high-tensile products having a flow stress of approx. 500 MPa (or more) and a thickness of approx. 12 mm (or more).

It is known from WO 2008/000 348 A1 for the end portion of the metal strip to be pre-bent by means of a straightening unit. According to WO 2008/000 348 A1, the combination of a bottom roller and of a top roller of the drive roller unit, in addition to a downholding roller that is upstream of the drive roller unit and is capable of being placed on the metal strip, can be used as the straightening unit. Alternatively, a straightening unit that is upstream or downstream of the drive roller unit can be used as the straightening unit. The upstream or downstream straightening unit comprises in each case three sequentially disposed straightening rollers that are placed in alternating manner on the one and on the other side of the metal strip, wherein in each case at least one of the straightening rollers being capable of being placed on the metal strip.

It is known from EP 0 906 797 A1 for a stretch leveler having a plurality of worker rollers to be disposed between the drive roller unit and the coiler, so that the metal strip is deflected on each worker roller. Cooling of the metal strip can additionally be performed between the worker rollers. A distribution of stress in the metal strip across the width of the strip can be influenced in particular by means of the assembly of EP 0 906 797 A1.

A method and a coiling installation of the type mentioned at the outset are known from WO 2011/073 016 A1. In WO 2011/073 016 A1, the end portion is cooled directly prior to coiling. The length of the end portion is chosen such that the latter is between one and five coilings.

A method and a coiling installation of the type mentioned at the outset are likewise known from JP 2012 024 793 A. In the case of JP 2012 024 793 A, the coil is first completely coiled. The outermost coiling of the coil is then cooled. The coil is rotated during cooling.

An equivalent disclosed content can be derived from JP 2010 162 594 A.

SUMMARY OF THE INVENTION

The object of the present invention lies in providing possibilities for causing a plastic deformation of the end portion of the metal strip in a simple manner.

According to the invention, a method of the type mentioned at the outset is designed in that a length of the end portion is larger than half the outermost coiling of the coil and smaller than the outermost coiling of the coil.

This can effect a stress profile to be incorporated in the end portion of the metal strip across the thickness of the strip in the case of the temperature of the end portion still being sufficiently high at that point in time at which asymmetric impingement with the cooling medium is performed. The equalization of this stress profile causes the curvature of the end portion.

The asymmetric impingement of the sides of the end portion by the cooling medium can be performed as required prior to the coiling of the end portion and/or during the coiling of the end portion and/or after the coiling of the end portion. Furthermore, the asymmetric impingement of the sides of the end portion by the cooling medium can be performed as required with a constant quantity of coolant, with a variable quantity of coolant, or in an intermittent manner.

The extent of the asymmetric impingement is preferably chosen such that the maximum curvature diameter is equal to half the coil diameter. On account thereof, it is achieved that the end portion bears under pressure on the next inner coiling of the coil. Any self-acting opening or unrolling of the coil is thereby reliably prevented.

It is possible for the plastic deformation of the end portion to be performed exclusively by the asymmetric impingement of the end portion with the cooling medium. Alternatively, it is possible for the plastic deformation of the end portion to be supported by means of a straightening unit that is upstream of the coiler.

Various design embodiments of the method are possible in the case of the plastic deformation being supported by a straightening unit that is upstream of the coiler.

Thus, for example, the combination of a bottom roller and of a top roller of the drive roller unit, with the addition of a downholding roller that is upstream of the drive roller unit, and which is capable of being placed on the metal strip, can be used as a straightening unit. Alternatively, a straightening unit that is upstream or downstream of the drive roller unit can be used as the straightening unit. The upstream or downstream straightening unit in this case comprises at least three sequentially disposed straightening rollers that are placed in an alternating manner on one side and then on the other side of the metal strip, wherein in each case at least one of the straightening rollers is capable of being placed on the metal strip.

According to the invention, a coiling installation of the type mentioned at the outset is designed so that the cooling installation is configured in such a manner that the end portion is impinged upon with the cooling medium across a length that is larger than half the outermost coiling of the coil and smaller than the outermost coiling of the coil.

The advantageous design embodiments of the coiling installation according to the invention correspond substantially to those of the method according to the invention.

The properties, features and advantages of this invention as described above, and the manner in which said properties, features and advantages are achieved, will be understood more clearly and obviously in conjunction with the description hereunder of the exemplary embodiments which are explained in more detail in conjunction with the drawings in which, in a schematic illustration:

Figure 1:
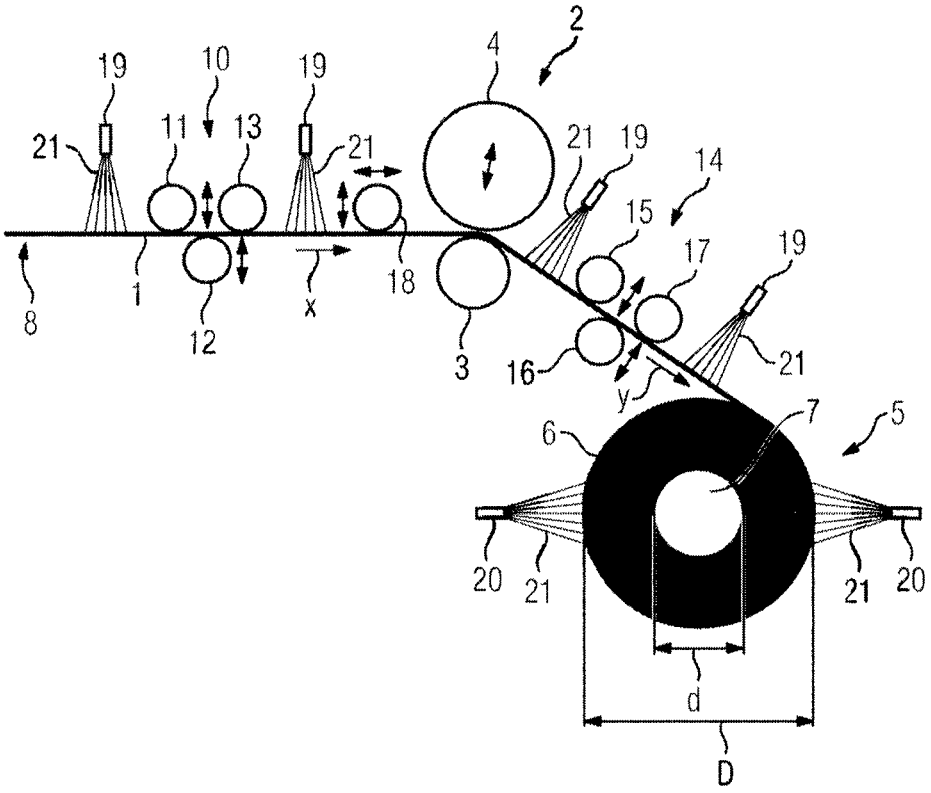
FIG. 1 shows a coiling installation.

A metal strip 1 is to be coiled by means of a coiling installation so as to correspond to the illustration in FIG. 1. The metal strip 1 can be composed of steel. Alternatively, the metal strip 1 can be composed of another metal, for example of aluminum or copper. The metal strip 1 has previously been rolled in a rolling line (not illustrated) and thereafter has been cooled in a cooling section (likewise not illustrated).

The coiling installation first has a drive roller unit 2. The drive roller unit 2 has a bottom roller 3 and a top roller 4. The bottom roller 3 is often disposed so as to be rigid. The top roller 4 is often capable of being placed on the bottom roller 3. In FIG. 1, this is indicated by a double arrow within the top roller 4. Additionally, the top roller 4 can be horizontally displaceable. The metal strip 1 by means of the drive roller unit 2 is deflected from a first transportation direction x to a second transportation direction y, and in the second transportation direction y is subsequently fed to a coiler 5 of the coiling installation. The first transportation direction x is typically horizontal. The second transportation direction y is typically directed so as to be obliquely downward. The metal strip 1 in the coiler 5 is coiled so as to form a coil 6. The coiler 5 has a coiling mandrel 7. The coil 6 at the beginning of the coiling procedure has an initial diameter d. The initial diameter d corresponds to the diameter of the coiling mandrel 7. The diameter of the coil 6 grows in the course of coiling of the metal strip 1 until said diameter reaches a final diameter D. The final diameter D corresponds to the coil diameter of the completely coiled coil 6.

Figure 2:
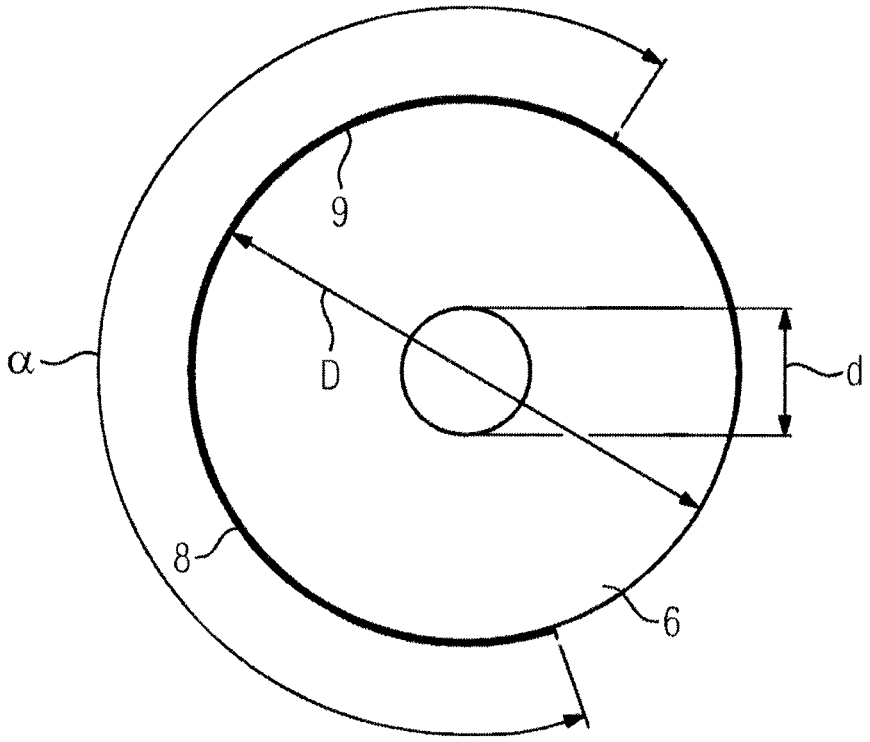
FIG. 2 shows a coiled coil.
Figure 3:
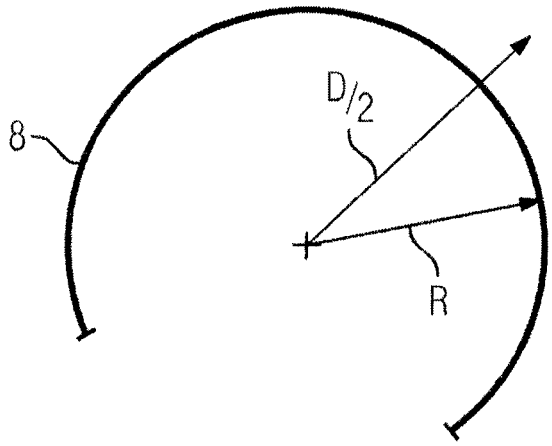
FIG. 3 shows a coiled end portion.

It is to be achieved in the context of the coiling procedure that an end portion 8 of the metal strip 1 after coiling is plastically deformed in such a manner that said end portion 8 in the uninfluenced state is curved at a sufficiently small curvature radius R (cf. FIGS. 2 and 3). The maximum curvature radius R is preferably half the coil diameter D.

In order for the uninfluenced state to be established, the end portion 8 can be separated from the remainder of the coil 6 and be subsequently placed onto the lateral edge such that the end portion 8 can freely roll up. The end portion 8 in this state assumes the curvature radius R. This state, which is typically a fictitious state, is illustrated in FIG. 3. In practice, the end portion 8 remains a component part of the coil 6. Therefore, the end portion 8 has inevitably to assume a curvature radius which is equal to half the coil diameter D. However, the end portion 8, proceeding from an uninfluenced state, is bent outward in an elastic manner. By virtue of the end portion 8 being bent open in an elastic manner, the end portion bears under pressure on the next inner coiling 9 of the coil 6.

The length of the end portion 8 can be determined according to requirements. According to the illustration in FIG. 2, the length of the end portion 8 is preferably larger than half the outermost coiling of the coil 6. In particular, the length of the end portion 8 can correspond to a circumferential angle $\alpha$ of 190°, 200°, 210°, . . . , 340°, 350°, up to less than 360°. Even higher values are possible for the circumferential angle $\alpha$. Intermediate values, for example 217° or 312°, can also be implemented.

In order for a plastic deformation of the end portion 8 of this type to be achieved, the coiling installation has a deformation installation. The required plastic deformation of the end portion 8 of the metal strip 1 is caused by means of the deformation installation.

The deformation installation can comprise a straightening unit, which is arranged upstream of the coiler 5. A plastic deformation of the end portion 8 is performed in this case in the straightening unit. The plastic deformation is performed prior to the coiling of the end portion 8 by means of the straightening unit.

One potential implementation of the straightening unit lies in that a dedicated straightening unit 10 is disposed upstream of the drive roller unit 2, in a manner corresponding to the illustration in FIG. 1. This straightening unit 10 hereunder is referred to as the upstream straightening unit.

According to the illustration in FIG. 1, the upstream straightening unit 10 comprises at least three straightening rollers 11 to 13. When viewed in the first transportation direction x, the straightening rollers 11 to 13 are disposed sequentially, placed in an alternating manner, on one and then on the other side of the metal strip 1. The straightening rollers 11 to 13 can be driven individually or in groups. Alternatively, the straightening rollers 11 to 13 can be configured to be non-driven. At least one of the straightening rollers 11 to 13 is capable of being placed on the metal strip 1, for example, the central straightening roller 12. In FIG. 1, this is indicated by a double arrow in the case of the central straightening roller 12. Alternatively or additionally, the two external straightening rollers 11, 13 can be capable of being placed on the metal strip 1. In FIG. 1, this is indicated by a double arrow between the two external straightening rollers 11, 13.

As an alternative to the upstream straightening unit 10, it is possible for a straightening unit 14 to be disposed downstream of the drive roller unit 2, in a manner corresponding to the illustration in FIG. 1. This straightening unit 14 hereunder is referred to as the downstream straightening unit.

The construction and the functioning mode of the downstream straightening unit 14 are analogous to the construction and the functioning mode of the upstream straightening unit 10. According to the illustration in FIG. 1, the downstream straightening unit 14 thus comprises at least three straightening rollers 15 to 17. When viewed in the second transportation direction y, the straightening rollers 15 to 17 are disposed sequentially, placed in an alternating manner on one and the other side of the metal strip 1. The straightening rollers 15 to 17 can be driven individually or in groups. Alternatively, the straightening rollers 15 to 17 can be configured so as to be non-driven. At least one of the straightening rollers 15 to 17 is capable of being placed on the metal strip 1, for example, the central straightening roller 16. In FIG. 1, this is indicated by a double arrow in the case of the central straightening roller 16 of the downstream straightening unit 14. Alternatively or additionally, the two external straightening rollers 15, 17 of the downstream straightening unit 14 can be capable of being placed on the metal strip 1. In FIG. 1, this is indicated by a double arrow between the two external straightening rollers 15 and 17.

Alternatively to the provision of the upstream or of the downstream straightening unit 10, 14, it is possible for the drive roller unit 2 to be extended so as to form a straightening unit. In this case, the straightening unit, has a downholding roller 18 in addition to the bottom roller 3 and to the top roller 4 of the drive roller unit 2. The downholding roller 18 is disposed upstream of the drive roller unit 2. The downholding roller 18 is capable of being placed on the metal strip 1. In FIG. 1, this is indicated by a double arrow orthogonal to the first transportation direction x in the case of the downholding roller 18. The downholding roller 18 can additionally also be positionable in the first transportation direction x. In FIG. 1, this is indicated by a double arrow parallel with the first transportation direction x in the case of the downholding roller 18. However, the positioning ability in the first transportation direction x is not inevitably required.

Due to a straightening unit being used, a mechanical-plastic deformation of the end portion 8 is performed prior to the coiling of the end portion 8 being performed. Independently of whether one of the straightening units 2+18, 10, 14 is present or not, a front and/or a rear cooling installation 19, 20 is present at all times. By means of the cooling installations 19, 20, the end portion 8 of the metal strip 1 is asymmetrically impinged upon by a cooling medium 21 (for example water or a water-oil mixture). When the front and/or the rear cooling installation 19, 20 are/is exclusively present, the asymmetrical impingement upon the end portion 8 with the cooling medium 21 causes entirely the desired plastic deformation of the end portion 8. When one of the straightening units 2+18, 10, 14 is additionally present, the asymmetrical impingement upon the end portion 8 with the cooling medium 21 partially causes the desired plastic deformation of the end portion 8. The plastic deformation of the end portion 8 in this case is supported by the straightening unit 2+18, 10, 14 that is present.

The front cooling installation 19 is disposed ahead or upstream of the coiler 5. An asymmetrical impingement prior to coiling is performed by the front cooling installation 19. The rear cooling installation 20 is disposed downstream in the coiler 5. An asymmetrical impingement is performed during coiling by means of the rear cooling installation 20 (cf. the impingement to the right of the coil 6 in FIG. 1) and/or after coiling (cf. the impingement to the left of the coil 6 in FIG. 1).

At least during the impingement upon the end portion 8 of the metal strip 1, to be supplied with a constant quantity of coolant. Alternatively, it is possible for the quantity of coolant to be variable during this time period. It is also possible for the end portion 8 to be impinged upon with the coolant 21 in an intermittent manner.

FIG. 1 illustrates that the external side of the end portion 8 is exclusively impinged upon with the cooling medium 21, specifically both ahead of as well as behind the drive roller unit 2, as well as in the coiler 5. Alternatively, it is also possible for the end portion 8 ahead of the coiler 5 to be impinged upon with the cooling medium 21 on the other side, however to a lesser extent. It is also possible for the asymmetric impingement by the cooling medium 21 to be performed exclusively ahead of or exclusively behind the drive roller unit 2.

In summary, the present invention thus relates to the following subject matter:

A rolled metal strip 1, in particular a steel strip 1, is deflected by means of a drive roller unit 2 from a first transportation direction x to a second transportation direction y and is fed to a coiler 5. The metal strip 1 in the coiler 5 is coiled so as to form a coil 6 having a coil diameter D. A plastic deformation of an end portion 8 of the metal strip 1 is caused such that the end portion 8 in the uninfluenced state is curved at a curvature radius R. The plastic deformation of the end portion 8 is at least partially caused by an asymmetric impingement upon the sides of the end portion 8 with a cooling medium 21. The impingement upon the end portion 8 with the cooling medium 21 is performed along a length of the end portion 8 that is longer than half the outermost coiling of the coil 6 but shorter than the outermost coiling of the coil 6.

The present invention has many advantages. In particular, the desired curvature of the end portion 8 of the metal strip 1 can be achieved in a simple manner and with high reliability.

While the invention has been illustrated and described in more detail by the preferred exemplary embodiment, the invention is not limited by the examples disclosed, and other variants can be derived therefrom by a person skilled in the art without departing from the scope of protection of the invention.

LIST OF REFERENCE SIGNS

1 Metal strip
2 Drive roller unit

3 Bottom roller
4 Top roller
5 Coiler
6 Coil
7 Coiler mandrel
8 End portion
9 Next inner coiling
10 Upstream straightening unit
11 to 13 Straightening rollers
14 Downstream straightening unit
15 to 17 Straightening rollers
18 Downholding roller
19 Front cooling installation
20 Rear cooling installation
21 Cooling medium
d, D Diameters
R Curvature radius
x, y Transportation directions
α Circumferential angle

The invention claimed is:

1. A method for coiling a rolled metal strip comprising:

driving the metal strip past a drive roller unit and deflecting the metal strip by the drive roller unit from a first transportation direction to a second transportation direction;

feeding the deflected metal strip to a coiler;

coiling the metal strip in the coiler to form a coil having a coil diameter;

causing a plastic deformation of an end portion of the metal strip such that the end portion in an uninfluenced state thereof is curved at a curvature radius;

at least partially causing the plastic deformation of the end portion by an asymmetric impingement on sides of the end portion with a cooling medium during coiling, prior to coiling, or prior and during the coiling;

wherein an outermost coiling of the formed coil has a length and the end portion has a length longer than half the length of the outermost coiling of the coil and shorter than the length of the outermost coiling of the formed coil.

2. The method as claimed in claim 1, further comprising performing the asymmetric impingement on the sides of the end portion of the metal strip with the cooling medium at least prior to the coiling of the end portion, at least during the coiling of the end portion, or at least after the coiling of the end portion.

3. The method as claimed in claim 2, further comprising performing the asymmetric impingement on the sides of the end portion with the cooling medium with at least one of a constant quantity of coolant, a variable quantity of coolant, and in an intermittent manner.

4. The method as claimed in claim 1, wherein the maximum curvature radius is equal to half the coil diameter.

5. The method as claimed in claim 1, further comprising supporting the plastic deformation of the end portion by a straightening unit located upstream of the coiler.

6. The method as claimed in claim 5, further comprising combining a bottom roller and a top roller of the drive roller unit which are on the driven metal strip with addition of a downholding roller which is on the driven metal strip and is located upstream of the drive roller unit;

each of the rollers is capable of being placed on the metal strip for being used as the straightening unit.

7. The method as claimed in claim 6, further comprising a straightening unit upstream or downstream of the drive roller unit, wherein the upstream or downstream straightening unit comprises at least three sequentially disposed straightening rollers placed in an alternating manner on one and the other side of the metal strip, and at least one of the rollers of the straightening unit is capable of being placed on the metal strip.

8. A coiling installation for coiling a rolled metal strip, comprising:

a drive roller unit that drives the metal strip and deflects the driven metal strip from a first transportation direction to a second transportation direction;

a coiler positioned downstream of the drive roller unit to receive the metal strip fed from the drive roller unit in the second transportation direction and to form a coil with the received metal strip having a selected coil diameter;

a deformation installation that causes a plastic deformation of an end portion of the metal strip such that the end portion in an uninfluenced state thereof is curved at a curvature radius, the deformation installation being a cooling installation that is arranged to impinge asymmetrically a cooling medium on the end portion at a location prior to, during, or prior to and during the coiling;

the cooling installation being arranged to impinge on the end portion with the cooling medium along a length that is longer than half a length of an outermost coiling of the coil and shorter than the length of the outermost coiling of the coil, wherein the cooling installation is positioned to supply the cooling medium upstream of the drive roller unit, positioned to deliver the cooling medium to the formed coil directly, or positioned to supply the cooling medium upstream of the drive roller unit and positioned to deliver the cooling medium to the formed coil directly; and a straightening unit located upstream of the coiler and configured for supporting the plastic deformation of the end portion.

9. The coiling installation as claimed in claim 8, wherein the cooling installation, during the passage of the end portion through the cooling installation, supplies the end portion coolant constantly, variably, or intermittently.

10. The coiling installation as claimed in claim 8, wherein the straightening unit comprises a bottom roller and a top roller of the drive roller unit which are on the driven metal strip and additionally a downholding roller which is on the driven metal strip and upstream of the drive roller unit, wherein at least one of the rollers of the straightening unit is capable of being placed on the metal strip.

11. The coiling installation of claim 8, further comprising the straightening unit is either upstream or downstream of the drive roller unit, wherein the upstream or downstream straightening unit comprises at least three sequentially disposed straightening rollers placed in an alternating manner on one and the other side of the metal strip, wherein at least one of the rollers of the straightening unit is capable of being placed on the metal strip.

12. A coiling installation for coiling a rolled metal strip, comprising:

a drive roller unit that drives the metal strip and deflects the driven metal strip from a first transportation direction to a second transportation direction;

a coiler positioned downstream of the drive roller unit to receive the metal strip fed from the drive roller unit in the second transportation direction and to form a coil with the received metal strip having a selected coil diameter;

a deformation installation that causes a plastic deformation of an end portion of the metal strip such that the end portion in an uninfluenced state thereof is curved at a curvature radius, the deformation installation being a cooling installation that is arranged to impinge asymmetrically a cooling medium on the end portion at a location prior to, during, or prior to and during the coiling; and the cooling installation being arranged to impinge on the end portion with the cooling medium along a length that is longer than half a length of an outermost coiling of the coil and shorter than the length of the outermost coiling of the coil, wherein the cooling installation is positioned to supply the cooling medium upstream of the drive roller unit, positioned to deliver the cooling medium to the formed coil directly, or positioned to supply the cooling medium upstream of the drive roller unit and positioned to deliver the cooling medium to the formed coil directly, wherein the maximum curvature radius is equal to half the coil diameter.

* * * * *